United States Patent [19]

Minks et al.

[11] 3,960,436

[45] June 1, 1976

[54] ELECTRICAL CONNECTOR

[75] Inventors: Werner Minks, Kleingeschaidt; Manfred W. Zebisch, Georgensgmund, both of Germany

[73] Assignee: International Standard Electric Corporation, New York, N.Y.

[22] Filed: Sept. 5, 1974

[21] Appl. No.: 503,395

[30] Foreign Application Priority Data

Sept. 10, 1973 Germany ..... 2345583

[52] U.S. Cl. ..... 339/221 M

[51] Int. Cl.[2] ..... H01R 9/16

[58] Field of Search ..... 339/217 R, 220 R, 220 C, 339/220 L, 220 T, 221 R, 221 M, 221 L, 176 M, 176 R, 176 M, 176 P, 17 R, 17 C, 17 LC

[56] References Cited

UNITED STATES PATENTS

| | | | |
|---|---|---|---|
| 2,497,484 | 2/1950 | Wood | 339/221 R |
| 2,875,425 | 2/1959 | Gilbert | 339/176 MP X |
| 3,148,929 | 9/1964 | Gordon | 339/218 M X |
| 3,196,377 | 7/1965 | Minich | 339/176 MP X |
| 3,223,960 | 12/1965 | Ruehlemann | 339/47 R X |
| 3,480,904 | 11/1969 | Gluntz | 339/176 MP X |
| 3,539,975 | 11/1970 | Donna | 339/17 R X |
| 3,703,700 | 11/1972 | Hasselbohm | 339/198 R |
| 3,807,045 | 4/1974 | Bennett et al. | 29/630 D X |

OTHER PUBLICATIONS

King, "Blue Ribbon Connectors", *Amphenol Engineering News*, Nov. 1954, vol. 7, No. 6, pp. 261, 264, 265.

*Bell Laboratories Record*, FIG. 2, Feb. 1958, p. 70.

*Primary Examiner*—Joseph H. McGlynn

*Assistant Examiner*—James W. Davie

*Attorney, Agent, or Firm*—Thomas L. Peterson

[57] ABSTRACT

An electrical connector having an insulator with semicircular recesses therein for receiving sheetmetal contacts. In the assembled condition, the contacts are applied with their broad sides to the straight inside wall of the recess while the cutting edges of the contacts are pressed into the curved inside wall of the recess. In this way the contact strips can be inserted in an oriented direction.

7 Claims, 14 Drawing Figures

ELECTRICAL CONNECTOR

BACKGROUND OF THE INVENTION

The present invention relates generally to an electrical connector and, more specifically, to an electrical connector employing an insulator and sheetmetal contact strips of substantially rectangular cross-section which are tight-fittingly inserted into curved recesses in the insulator.

There is a need for the present invention especially in the case of multipoint connectors of standardized design, in which the sheetmetal contacts are arranged in accordance with the international modular contact spacing 1 M = 2.54 mm (0.100 in.). The invention, however, can also be applied to a contact supporting plate employing strip-shaped contact members, such as in the stator plate of a rotary multi-position switch.

As regards multipoint electrical connectors it is known to mount the contact members in the form of contact strips 0.1 mm thick and 1.1 mm wide on an insulator designed as an insulation comb. Such type of contact is bent by 180° on its plug-in side, to form a U-shaped element. Mounting of the thus bent contact is effected in such a way that the contact is inserted with its non-bent end in a slot of the insulator until reaching a limit stop of its bent U-leg or U-base, and a short piece of the other U-leg projecting out of the slot is form-lockingly connected to the insulator. To this end, for example, nose members may be arranged, for example, along the longitudinal edges of the contacts. In this type of mounting, the U-leg or U-base of the contact applied to the insulator serves as the mounting support while the nose members arranged on the other U-leg serve to act as mounting abutments.

An insulator thus equipped with contacts, however, has several disadvantages. In cases where the contacts are inserted with a press fit into the slot-shaped recesses of the insulator, the latter is easily caused to become cracked, with these cracks likely to impair the mechanical stability of the insulator. If the contacts are inserted in a loosely fitting manner into the slot-shaped recesses, thin gaps result between the contacts and the recesses which is likely to transport the colophony used during the soldering of the connecting lugs owing to capillary effects. This results in an impairment of the electrical contact properties of the U-legs of the contacts which, as is well known, are coated with a contact material, such as gold, for the purpose of obtaining special contacting properties.

These disadvantages can be overcome by designing the recesses in which the contact strips are embedded, not in a slot-shaped manner, but circularly. In the conventional type of mounting the sheetmetal contact member is inserted in such a way into a cylindrical recess in the insulator that the sheetmetal cutting edges of the contact are pressed into the limiting wall of the recess. From this the advantage results that the sheetmetal contact member can be inserted with a press fit, hence safe against torsion and displacement, without causing the aforementioned capillary effects or cracks in the insulator. The known solution, however, is again disadvantageous in cases where the contact members in the form of contact strips are supposed to be inserted in a certain oriented manner in an insulator or any other supporting plate.

Furthermore, disadvantages will always result in cases where the individual contacts are to be arranged at a very small spaced relation, e.g. at a spaced relation of 1 M = 2.54 mm into the insulator in a manner safe against distortions and displacements. In these cases only little space is available for notching or cutting noses, or the like into the sheetmetal cutting edges with the aid of stable forces for the purpose of forming a mounting support for the contact.

It is the purpose of the present invention to provide a multipoint connector in which sheetmetal contacts are retained in the connector insulator in a torsion- and displacement- proof manner as well as in an oriented direction, without the aforementioned capillary effects or cracks appearing in the insulator.

SUMMARY OF THE INVENTION

According to the principal aspect of the present invention, a multipoint connector is provided in which the aforementioned problems are solved by designing the contact recesses in the insulator as semicircular openings. A contact is inserted into each recess with its broad side adjacent to the straight inside wall of the recess and the cutting edges of the contact pressed into the curved inside wall of the recess.

The invention offers the advantage that by the use of a semicircular recess instead of a circular bore for receiving the contact, the latter can be inserted in an oriented direction with a press fit without cracks appearing in the insulator or in a contact supporting plate, as would be the case if slot-shaped recesses were used. Moreover, the invention offers the advantage that by the use of semicircular openings for receiving the contacts, just like in the known case of using circular bores, there will not appear any capillary effects, because thin gaps between the contacts and the openings serving to receive the latter, are basically avoided. The invention is of particular advantage to the manufacture of multipoint connectors having a very small spacing between holes, e.g. in which 1 M = 2.54 mm, because semicircular openings occupy less space than circular openings. Owing to this space-saving construction there is also met the requirement for miniaturized components or subassemblies. A further advantage of the invention results from the fact that the form-locking connection between the contacts and the insulators is established by notching the contacts in a plane extending vertically in relation to the broad side of the contact strip. By this arrangement, greater air and creepage paths will result between the contacts than in the conventional arrangement, because the notchings do not enlarge the width of the contacts. Moreover, it is possible to use stable forces (male molds) for effecting the notching, because these work in a plane vertically in relation to the broad side of the contacts and not, as hitherto, in the longitudinal direction of the contacts, so that in this case the spaced relation between contacts is irrelevant and, consequently, may also be very small as is prescribed, for example, by the international contact spacing 1 M = 2.54 mm.

DESCRIPTION OF THE PREFERRED EMBODIMENTS

Figure 1A:
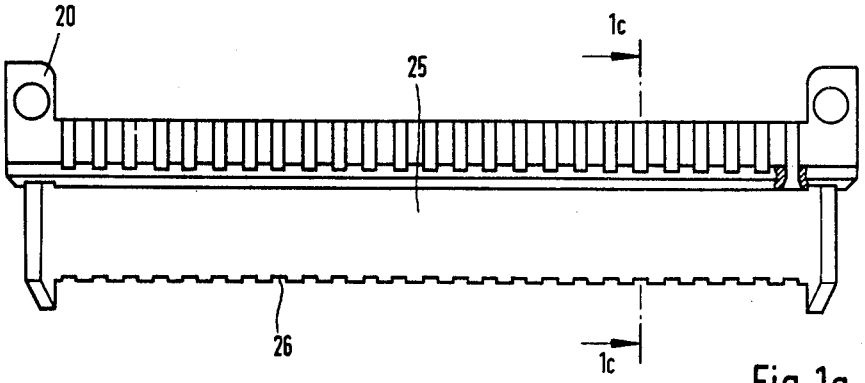
FIG. 1*a* shows the insulator of a multipoint connector according to the invention in a side view.
Figure 2A:
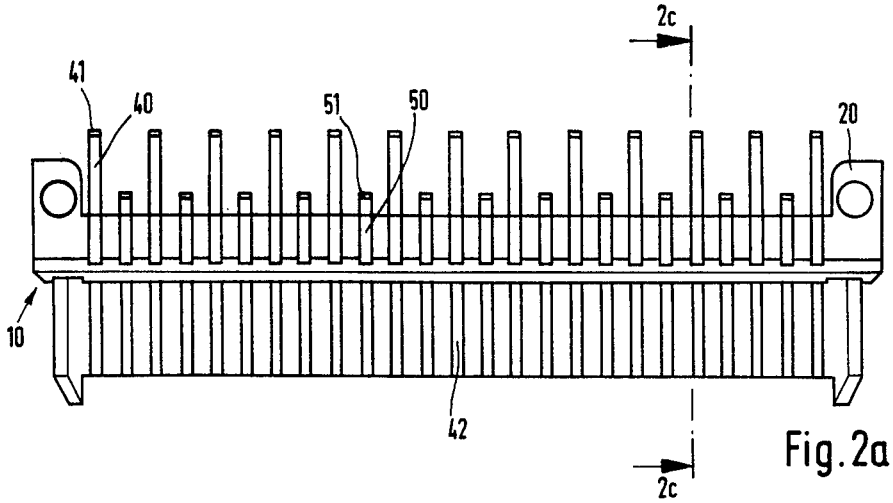
FIG. 2*a* is a side view of a multipoint connector according to the invention, embodying the insulator illustrated in FIGS. 1*a* to 1*e* and equipped with contacts.
Figure 2D:
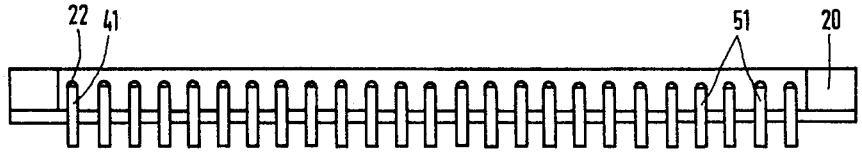
FIG. 2*d* is a top view of the multipoint connector.
Figure 2B:
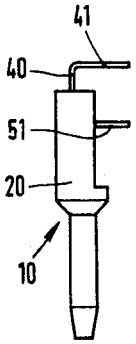
FIG. 2*b* shows this multipoint connector in a front view.

The multipoint connector 10 shown in FIG. 2*a* consists of an insulator 20 and contact strips 40, 50. The insulator is made of one part and consists of a mechanically and electrically high-quality insulating material, e.g. a polycarbonate. The insulator shown in FIGS. 1*a* and 2*a* may be made by way of die casting. The die-cast multipoint connector 10 can be used for a printed circuit as well as for wire-connection applications.

A type model suitable for the direct solderng to printed circuits is shown in FIGS. 2*a* to 2*g*, in which the contacts are shown to have rectangularly bent portions 41, 51. The basic measurements for the entire construction corresponds to the international modular contact spacing applicable to printed circuits: 1 Module = 1M = 2.54 mm. As may be seen from FIGS. 2*a* and 2*b*, the bent portions 41, 51 of the contacts 40, 50 lie in two parallel planes, with the spacing between them chosen to be an integral multiple of 1 M, but with the spacing between the individual contacts just amounting to 1 M. Multipoint connectors are designed as a rule in contact arrangements having 11, 25 or 33 positions, and are thus suitable for use in equipment employing plug-in type units, especially printed circuits. As a rule, the plug-in unit carries the multipoint connector whereas the female connector (not shown) is mounted to the equipment.

Figure 1D:
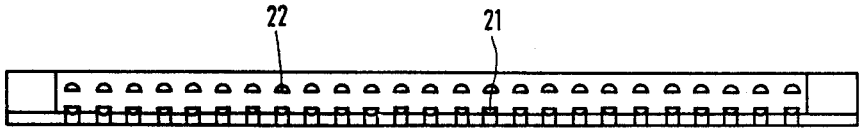
FIG. 1*d* shows the insulator in a top view.
Figure 1B:
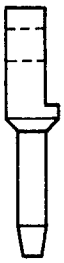
FIG. 1*b* shows this insulator in a front view.
Figure 1E:
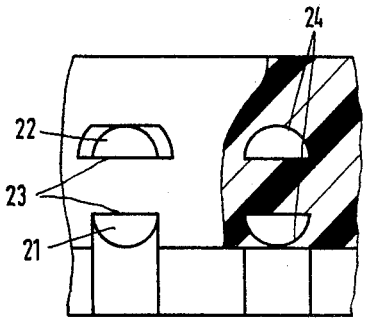
FIG. 1*e*, on an enlarged scale, shows a part of the insulator of FIG. 1*d*, in a semi-sectional view.
Figure 2C:
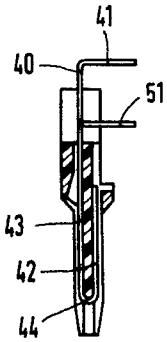
FIG. 2*c* is a vertical sectional view thorugh the multipoint connector taken along line 2*c*—2*c* of FIG. 2*a;*

As contacts for the multipoint connector 10 rectangular cross-section type sheetmetal contact strips 40, 50 are used. These contact strips are punched out of a sheetmetal band of corresponding size so as to be provided with sharp sheetmetal cutting edges or corners. The sheetmetal contact strip shown in FIG. 2*c* is folded in a U-shaped manner within the range of its contacting points, i.e. in such a way that there will result one shorter U-leg 42 and one longer U-leg 43. The contacts are accommodated in curved recesses provided in the insulator 20, as may be best seen in FIGS. 1*d* and 1*e*. These recesses are designed as semicircular openings 21, 22 and, therefore, each has one straight inside wall 23 and one curved inside wall 24.

Insertion of the sheetmetal contacts 40, 50 into the semicircular openings 21, 22 of the insulator 20 is carried out in such a way that the contacts are positioned with their broad side 52 adjacent to the straight inside wall 23 of the opening and the cutting edges or corners 53 pressed into the curved inside wall 24 deforming the wall. By the mounting of the broad sides of the contacts adjacent to the straight inside wall 23 of the circular opening 21, 22 it is possible to effect an oriented pressing of the contacts into the insulator 20. This is of particular significance in cases where contacts of the multipoint connector are to be soldered into the holes of a printed circuit board arranged in accordance with standardized contact spacings.

In the embodiment shown in the accompanying drawings, the insulator 20 has two parallel rows of semicircular openings 21, 22 with each opening 21 of the one row being opposed by an opening 22 of the other row. Two such opposed openings are arranged in a mirror-symmetrical manner in relation to one another so that the straight inside walls 23 of the openings of each pair of openings are arranged directly opposite each other. In this way it is possible for each such pair of openings 21, 22 to take up the two U-legs 42, 43 of a U-shapedly folded sheetmetal contact strip 40 in such a way that each U-leg will come to lie with its broad side against the straight inside wall 23 of an opening. From the use of such pairs of openings 21, 22 for receiving U-shapedly folded contact strips 40, 50, there will result the advantage that the contacting points of the contacts are inserted in the insulator 20 not only in oriented directions, but also in a distortion- and displacement-proof manner with respect to lateral stresses. In order that the cutting edges of the contacts 40, 50 can be pressed into the curved limiting wall of the semicircular openings 21, 22, the width of the contacts are adapted to the diameters of the openings.

Figure 1C:
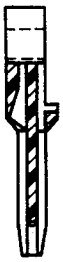
FIG. 1*c* is a vertical sectional view through the insulator taken along line 1c—1c of FIG. 1*a*.

With a view to the saving of contact material it is appropriate to employ U-shapedly folded sheetmetal contact strips 40, 50 each having different lengths of legs, as may be seen in FIG. 2*c*. The actual contacting points of the multipoint connector 10 which are brought into contact with the contact springs of a corresponding female connector (not shown), are constituted in this embodiment by the freely exposed U-legs 42, 43 and the U-base 44. For receiving the U-shapedly folded sheetmetal contact strips 40, 50 each with different lengths of their legs, the two rows of semicircular openings 21, 22 are arranged in different planes of the insulator 20 (FIGS. 1*c* and 2*c*).

For increasing the stability of the contacting points with respect to lateral stresses, the insulator 20 is provided with an insulation comb portion 25 provided with parallel spaced grooves 26 at the outer edges thereof in which the U-shapedly folded contact strips 40, 50 are inserted with their U-bases 44 while the U-legs 42, 43 of the contact strips extend around the insulation comb. This insulation comb additionally serves to stiffen or reinforce the multipoint connector 10 in the plug-in direction as well as vertically in relation to the plane of the contacts.

Figure 2E:
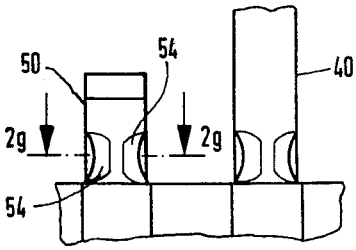
FIG. 2*e*, on an enlarged scale, shows a part of the multipoint connector of FIG. 2*a;*
Figure 2F:
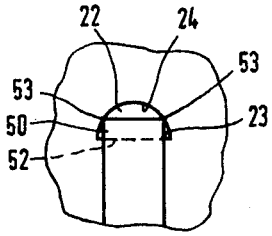
FIG. 2*f*, in a top view, shows the left-hand half of the detail of the multipoint connector shown in FIG. 2*e;*
Figure 2G:
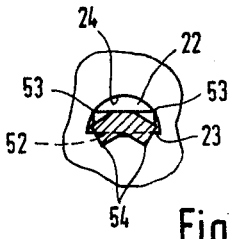
FIG. 2*g* is a horizontal sectional view taken along line 2*g* —2*g* of the multipoint connector shown in FIG. 2*e;*

The form-locking connection between the insulator 20 and the contacts 40, 50 is effected on one hand in that the cutting edges 53 of the contacts are pressed into the curved inside walls 24 of the semicircular openings 21, 22. This ensures the necessary protection against twisting which is required for the contacts. On the other hand, it is necessary to prevent the contacts from being longitudinally displaced in the insulator. For this purpose, it is possible, for example, to provide nose members 54 along the longitudinal edges of the contact strips as seen in FIGS. 2*e* and 2*g*. In this method of mounting, the U-base 42, 43 of the U-shapedly folded contacts applied to the insulation comb 25 serves to form one mounting support while the warped nose members 54 on the contacts serve to act as the mounting abutments.

Figure 3B:
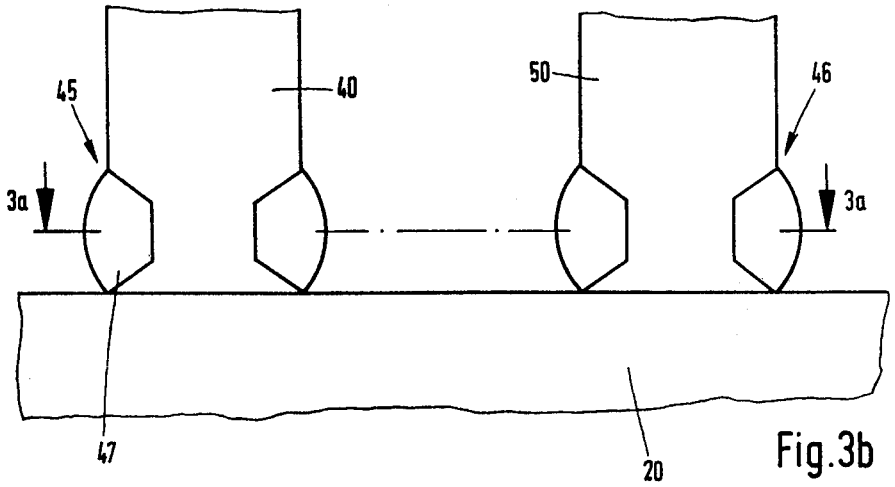
FIG. 3*b* is a top view of the deformed contacts shown in FIG. 3*a*, for use in a multipoint connector according to the invention.
Figure 3A:
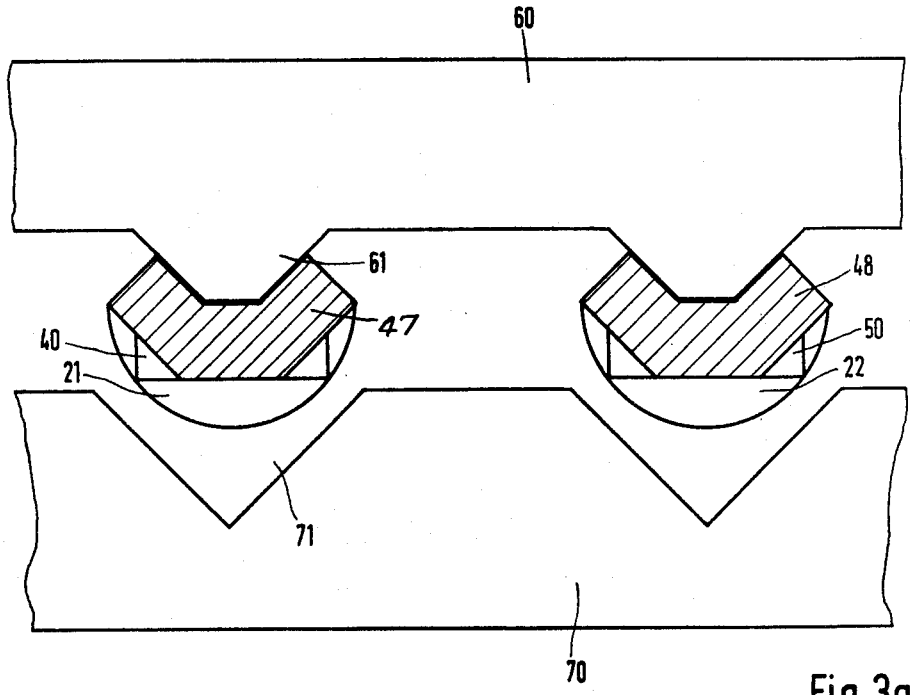
FIG. 3*a*, in enlarged horizontal cross-section taken along line 3*a*—3*a* of FIG. 3*b*, shows the contacts of a multipoint connector according to the invention within the range of the form-locking connection between the contacts and the insulator of the connector, as well as a device for establishing this form-locking connection, in a schematic representation.

In the case of multipoint connectors employing contacts 40, 50 at a contact spacing of 1 M = 2.54 mm, it is difficult for the nose members to be warped to the longitudinal edges of the contacts. For this reason it is more advantageous to establish the form-locking connection between the insulator and the contacts for the purpose of preventing longitudinal displacements of the contacts by notching the contacts in a direction vertically in relation to the broad side of the contacts. As seen in FIGS. 3*a* and 3*b*, this form-locking connection is established in such a way that a short piece 45, 46 of the contacts projecting out of the semicircular openings 21, 22, are deformed to a notch 47, 48 extending at least partly over the marginal range of the straight inside wall 23 of the semicircular opening. As shown in FIG. 3*a*, the contacts can be deformed preferably to the shape of a notch 47, 48 having a trough-shaped cross-section. A device suitable for this purpose is likewise shown in FIG. 3*a*. This device consists of a top force (male mold) 60 formed with trapezoidal elevations 61 which are tapered toward the outside, capable of being applied to the one broad side of the contacts, and an oppositely arranged cavity (female mold) 70 having corresponding recesses 71 tapered toward the inside, and capable of being pressed against the other broad side of the contact for the purpose of forming the trough-shaped notches 47, 48. From FIGS. 3*a* and 3*b* it is particularly evident that the notches produced with the aid of the device 60, 70 do not increase the width of the contacts as would be the case if the nose members were to be warped to the longitudinal edges thereof. For this reason the air and creepage paths in the mounting arrangement according to the invention are greater than in conventional methods. On the other hand, for manufacturing the notches, it is possible to use stable forces (molds) because in the direction vertically in relation to the broad side of the contacts there is sufficient space for effecting the deforming in this particular direction.

To form the contacts, flat contacts are first stamped out of flat contact metal strip material. The individual contacts are then arranged in a magazine (not shown) at the desired spaced relation and in accordance with the desired number of pole positions. As a rule, this spacing amounts to 1 M = 2.54 mm. The number of positions depends on the type of equipment to be provided with plug-in units, especially with printed circuits, and as a rule there are chosen 11, 25 or 33 positions.

The magazined contacts are fed to a common bending device (not shown) in which they are given the U-shape. From this there will result the differently long U-legs 42, 43 as well as the U-bases 44. The common bending device simultaneously serves to equip the insulator 20 with the contacts. With the aid of this device, the contacts are jointly inserted in the semicircular openings 21, 22 until reaching the limit stop on the inside surface of the U-base 44 on the insulator 20 without any clearance, so that the cutting edges of the sheetmetal contacts are pressed into the curved inside wall 24. The limiting stop of the U-base 44 on the insulation comb 25 will thus form one mounting support for the contacts.

This is followed by the joint grooving of the contacts to the insulator 20 for the purpose of forming the mounting abutment. To this end preferably the grooving device as shown in FIGS. 3*a* and 3*b* is used consisting of the force (male mold) 60 and of the cavity (female mold) 70. The grooving (notching) is carried out in a direction vertically in relation to the broad side of the contacts.

In certain cases, prior to the joint grooving of the contacts, the connecting ends 41, 51 thereof are jointly bent rectangularly. The bent portions 41, 51 serve the insertion into the plug-in holes of a printed circuit board arranged in accordance with the required contact spacing.

As already mentioned hereinbefore, the invention may also be used for contact supporting boards employing contact strips. This may be, for example, the contact supporting board of a rotary switch to be provided with strip-like stationary contact members. It is the object of the invention to enable the mounting of such contact strips in an oriented direction.

What is claimed is:

1. In an electrical connector comprising an insulator and sheetmetal contacts of substantially rectangular cross-section tight-fittingly inserted into curved recesses in said insulator, each said contact having parallel flat broad sides, the improvement which comprises:

each said recess in said insulator having a semicircular configuration providing a straight inside wall and a curved inside wall; and the contact in each said recess being positioned with one of its broad sides adjacent to said straight inside wall and the corners thereof opposite to said one side pressed into said curved inside wall.

2. An electrical connector as set forth in claim 1 wherein:

said insulator has at least two parallel rows of said recesses therein, each of said recesses of one row being opposed by one recess of the other row providing a pair of recesses;

each said contact having a U-shaped end providing a pair of parallel legs; and each said pair of recesses receiving the legs of the U-shaped end of one of said contacts with the broad sides of said legs being adjacent to the straight inside walls of said recesses.

3. An electrical connector as set forth in claims 2 wherein:

one leg of the U-shaped end of each contact is longer than the other leg; and said two rows of recesses are arranged in different planes of said insulator.

4. An electrical connector as set forth in claim 2 wherein:

the straight inside walls of the recesses of each pair of recess are disposed to face one another in a mirror-symmetrical arrangement.

5. An electrical connector as set forth in claim 1 wherein:

a short portion of each said contact projecting out of its respective recess is deformed outwardly transverse to the plane of the broad side of the contact.

6. An electrical connector as set forth in claim 5 wherein:

said contact portion is deformed to the shape of a groove at least partly extending over the marginal range of the straight inside wall of its respective recess.

7. An electrical connector as set forth in claim 6 wherein:

said contact portion is deformed to the shape of a groove having a trough-shaped cross-section.

* * * * *